US007051776B2

(12) United States Patent
Liu

(10) Patent No.: US 7,051,776 B2
(45) Date of Patent: May 30, 2006

(54) ROTARY CUTTER FOR A WOOD PLANING MACHINE

(75) Inventor: Chin Yuan Liu, Taichung (TW)

(73) Assignee: Shinmax Industry Co., Ltd., Taichung Hsien (TW)

( * ) Notice: Subject to any disclaimer, the term of this patent is extended or adjusted under 35 U.S.C. 154(b) by 0 days.

(21) Appl. No.: 11/053,485

(22) Filed: Feb. 8, 2005

(65) Prior Publication Data

US 2005/0193884 A1 Sep. 8, 2005

(30) Foreign Application Priority Data

Mar. 5, 2004 (TW) ..... 93203292 U

(51) Int. Cl.
*B27C 1/00* (2006.01)
*B27C 5/00* (2006.01)
*B27G 13/02* (2006.01)

(52) U.S. Cl. ..... 144/117.1; 144/218; 144/225; 144/230; 407/48; 83/698.41

(58) Field of Classification Search ..... 144/114.1, 144/117.1, 121, 129, 130, 218, 221, 230, 144/241, 225–228; 407/40, 47, 48, 107; 83/698.41, 698.42, 698.51, 699.51
See application file for complete search history.

(56) References Cited

U.S. PATENT DOCUMENTS 1,294,638 A * 2/1919 Draper ..... 144/225
4,066,111 A * 1/1978 Klebe, Jr. ..... 30/475
5,398,739 A * 3/1995 Everts et al. ..... 144/225
6,626,214 B1 * 9/2003 Hu ..... 144/221

* cited by examiner

*Primary Examiner*—Derris H. Banks
*Assistant Examiner*—Shelley Self
(74) *Attorney, Agent, or Firm*—Frommer Lawrence & Haug LLP; Ronald R. Santucci

(57) ABSTRACT

A rotary cutter includes: an elongated polygonal shaft that defines a rotation axis, that has blade-mounting surfaces parallel to and surrounding the rotation axis, and that is formed with blade-aligning studs for aligning a blade, the blade-mounting surfaces being equidistant from the rotation axis, two adjacent ones of the blade-mounting surfaces defining an angle therebetween, the angles defined by the blade-mounting surfaces being equal; blade-fastening plates, each of which is attached to and cooperates with a respective one of the blade-mounting surfaces of the shaft to define a blade-receiving gap therebetween for receiving the blade; and fastening screws for fastening the blade to the respective one of the blade-mounting surfaces of the shaft.

1 Claim, 6 Drawing Sheets

ROTARY CUTTER FOR A WOOD PLANING MACHINE

CROSS-REFERENCE TO RELATED APPLICATION

This application claims priority of Taiwanese Application No. 093203292, filed on Mar. 05, 2004.

BACKGROUND OF THE INVENTION

1. Field of the Invention

This invention relates to a rotary cutter for a wood planing machine, more particularly to a rotary cutter including a polygonal shaft formed with blade-mounting surfaces for mounting of blades thereon.

2. Description of the Related Art

FIGS. 1 to 3 illustrate a conventional wood planing machine that includes a base 11, posts 12 standing upright from the base 11, a cutter carriage 13 mounted movably on the posts 12, and a rotary cutter 14 mounted rotatably on the cutter carriage 13. The rotary cutter 14 includes a shaft 15 that is formed with a plurality of recesses 153, and a plurality of blades 16, each of which is mounted securely on the shaft 15 and each of which is disposed in a respective one of the recesses 153. A pair of urging members 154 are disposed in each of the recesses 153 for adjustment of the depth of the blade 16 in the respective recess 153. A pressing plate 17 and screw means 19 are used for pressing the blade 16 against a mounting wall 155 of the shaft 15 upon adjustment of the screw means 19 to abut against an opposite wall 156 of the shaft 15 opposite to the mounting wall 155.

Since the recesses 153 are very narrow, tightening and loosening of the screw means 19 are relatively inconvenient during replacement of the blades 16.

SUMMARY OF THE INVENTION

Therefore, the object of this invention is to provide a rotary cutter for a wood planing machine that is capable of overcoming the aforesaid drawback of the prior art.

According to the present invention, a rotary cutter for a wood planing machine includes: an elongated polygonal shaft that defines a rotation axis, that has axially extending blade-mounting surfaces parallel to and surrounding the rotation axis, and that is formed with threaded holes indented inwardly from each of the blade-mounting surfaces and aligned in an axial direction relative to the rotation axis, and blade-aligning studs projecting outwardly from each of the blade-mounting surfaces for aligning a blade during mounting of the blade on a respective one of the blade-mounting surfaces of the shaft, the blade-mounting surfaces being equidistant from the rotation axis, two adjacent ones of the blade-mounting surfaces defining an angle therebetween, the angles defined by the blade-mounting surfaces being equal; a plurality of elongated blade-fastening plates, each of which is attached to a respective one of the blade-mounting surfaces of the shaft, each of which is formed with a plurality of through-holes that are registered with the threaded holes at the respective one of the blade-mounting surfaces, and each of which cooperates with the respective one of the blade-mounting surfaces to define a blade-receiving gap therebetween for receiving the blade therein; and a plurality of fastening screws, each of which extends through a respective one of the through-holes in a respective one of the blade-fastening plates and the blade-receiving gap and engages threadedly a respective one of the threaded holes in the shaft so as to fasten the blade to the respective one of the blade-mounting surfaces of the shaft upon tightening of the fastening screws.

BRIEF DESCRIPTION OF THE DRAWINGS

Other features and advantages of the present invention will become apparent in the following detailed description of the preferred embodiment of the invention, with reference to the accompanying drawings. In the drawings.

DETAILED DESCRIPTION OF THE PREFERRED EMBODIMENT

Figure 1:
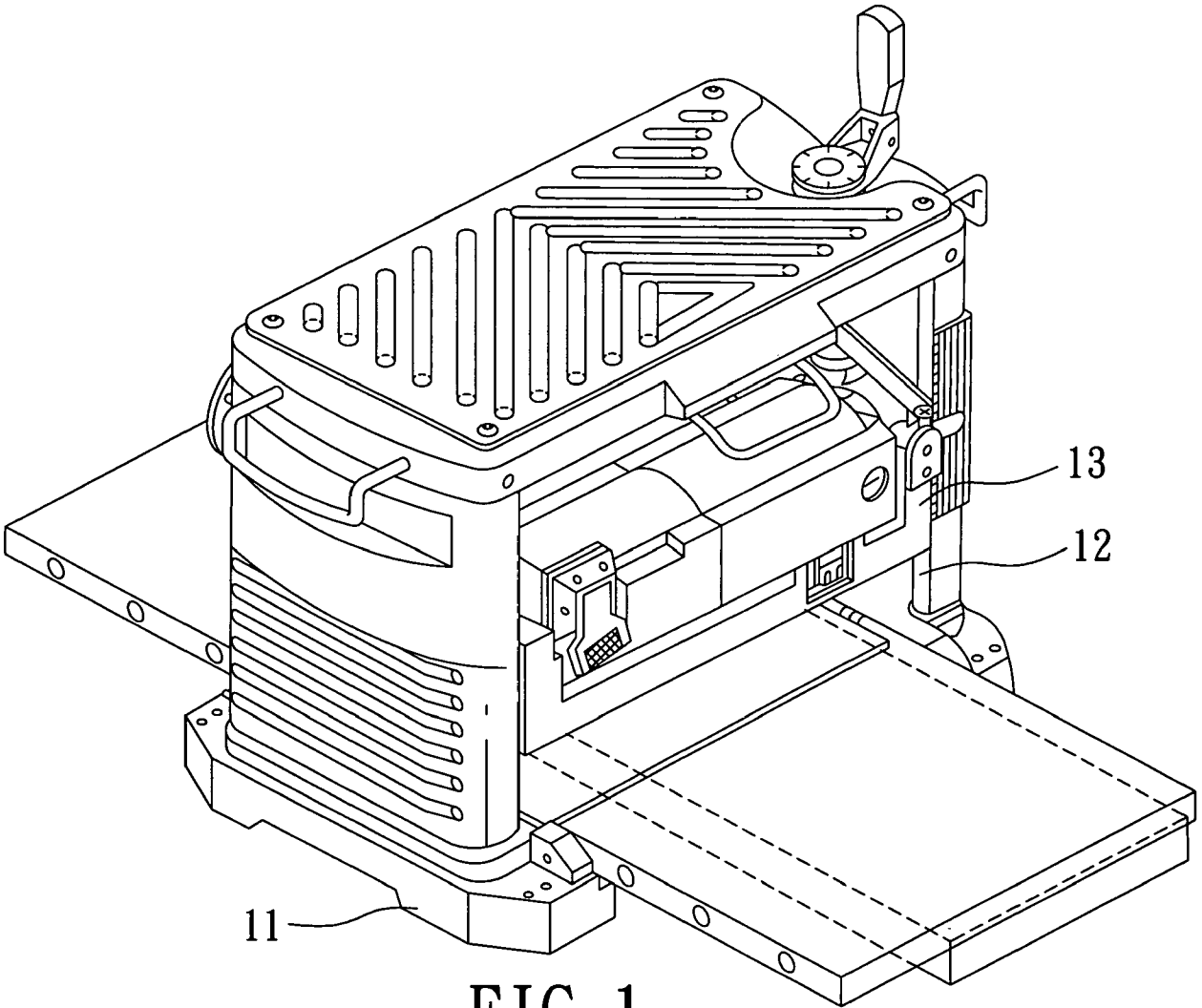
FIG. 1 PRIOR ART
FIG. 1 is a perspective view of a conventional wood planing machine.
Figure 2:
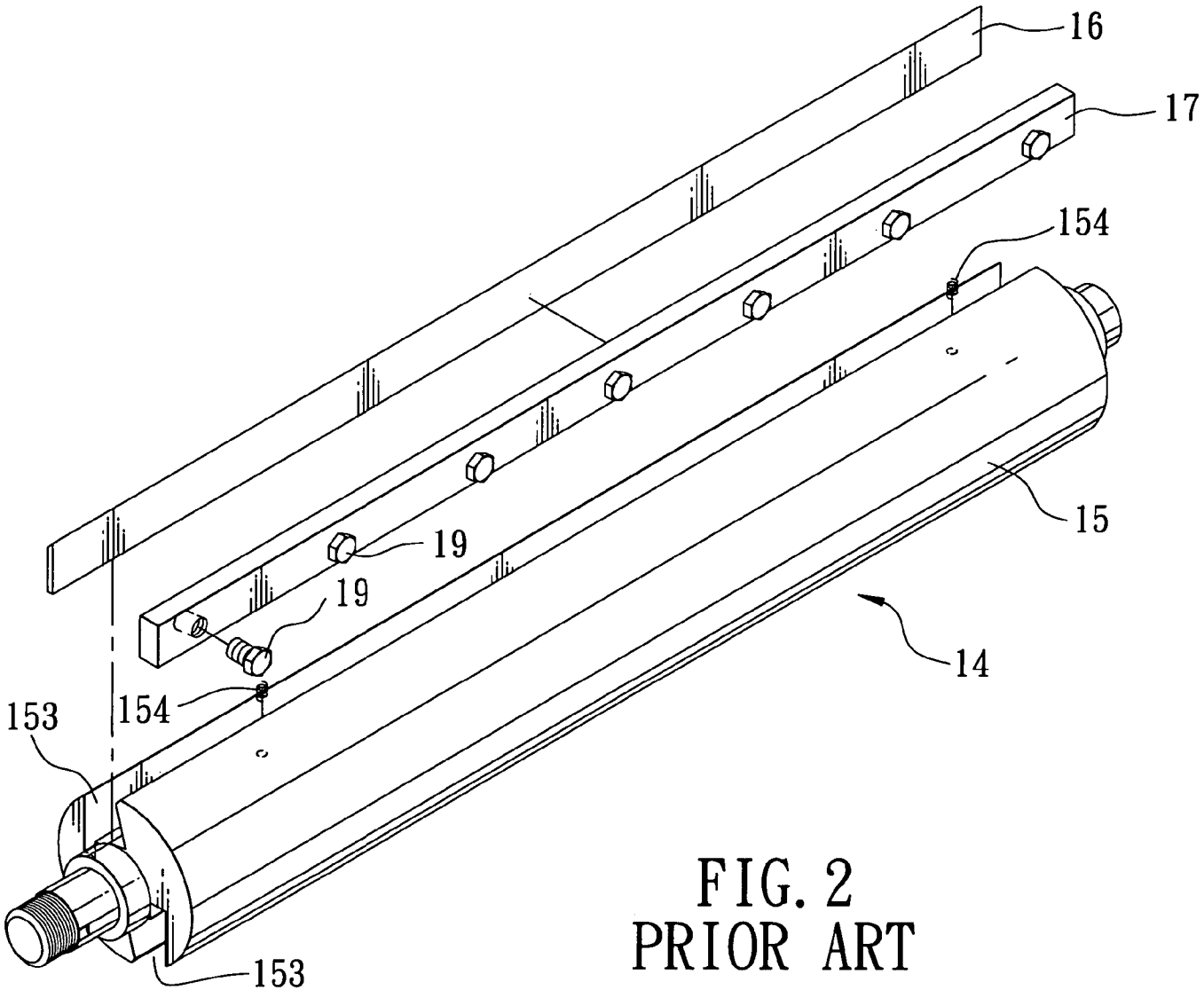
FIG. 2 PRIOR ART
FIG. 2 is an exploded perspective view of a rotary cutter of the conventional wood planing machine of FIG. 1.
Figure 3:
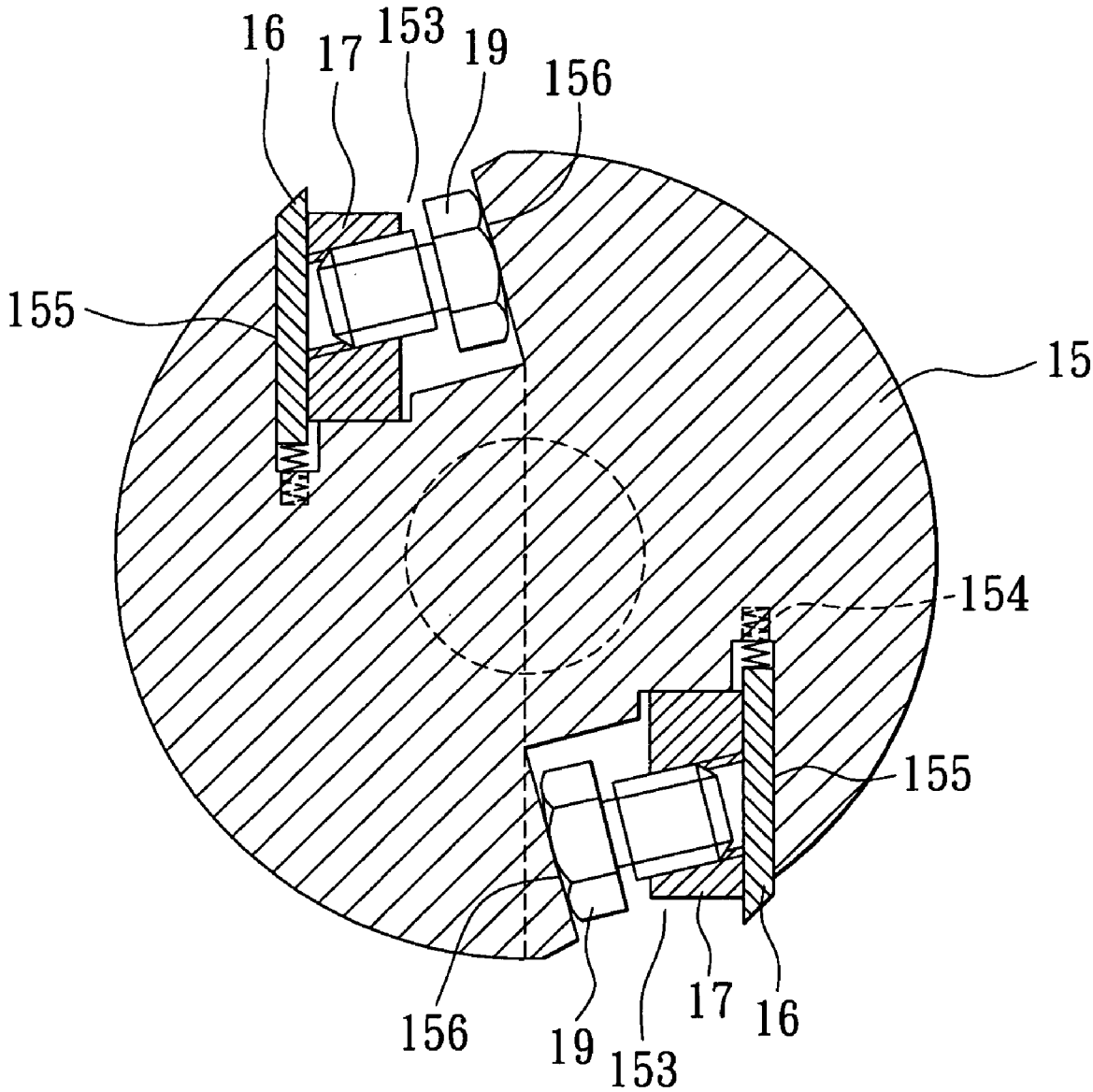
FIG. 3 PRIOR ART
FIG. 3 is a sectional view of the rotary cutter of the conventional wood planing machine of FIG. 1.
Figure 4:
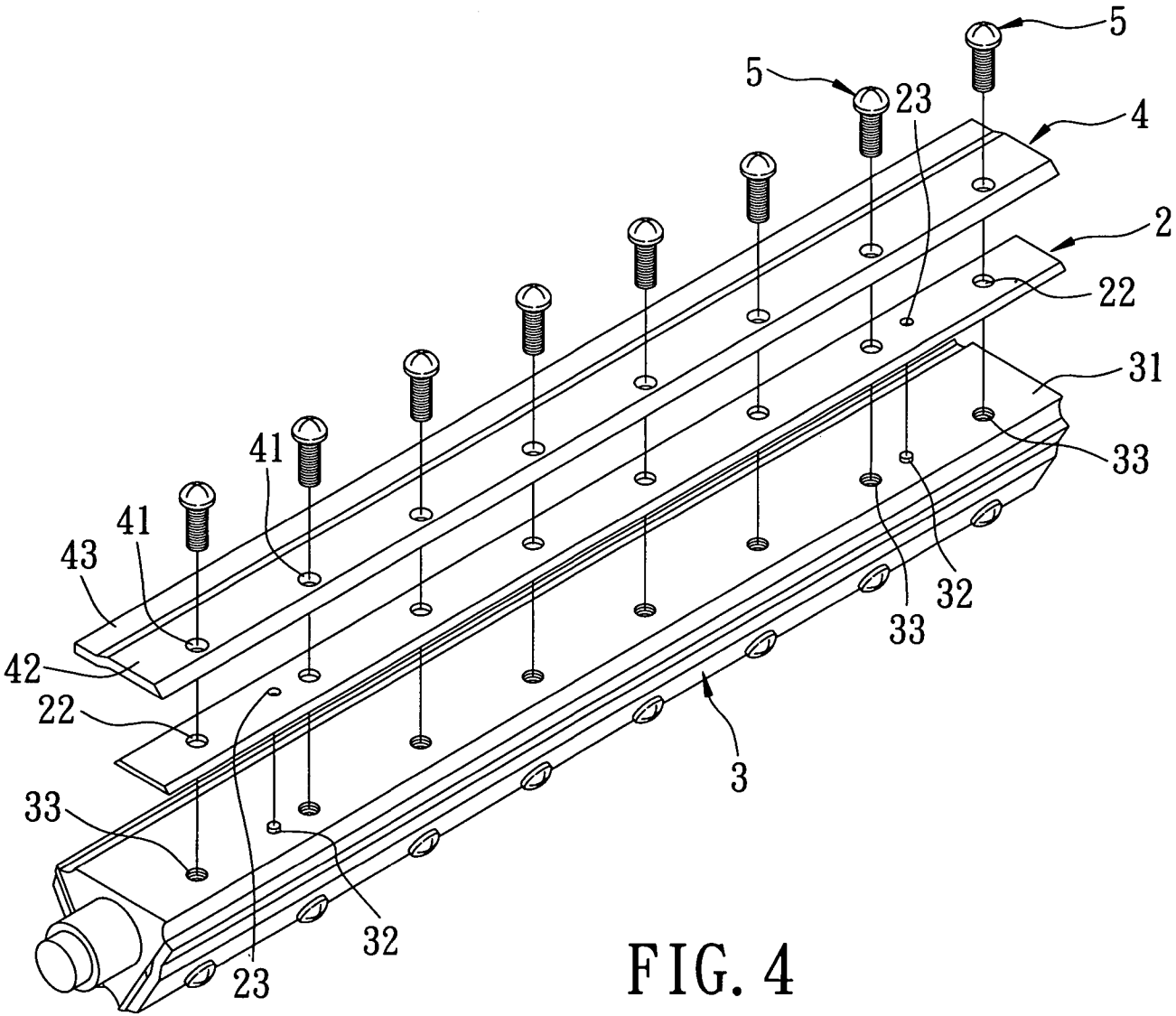
FIG. 4 is an exploded perspective view of the preferred embodiment of a rotary cutter for a wood planing machine according to this invention.
Figure 5:
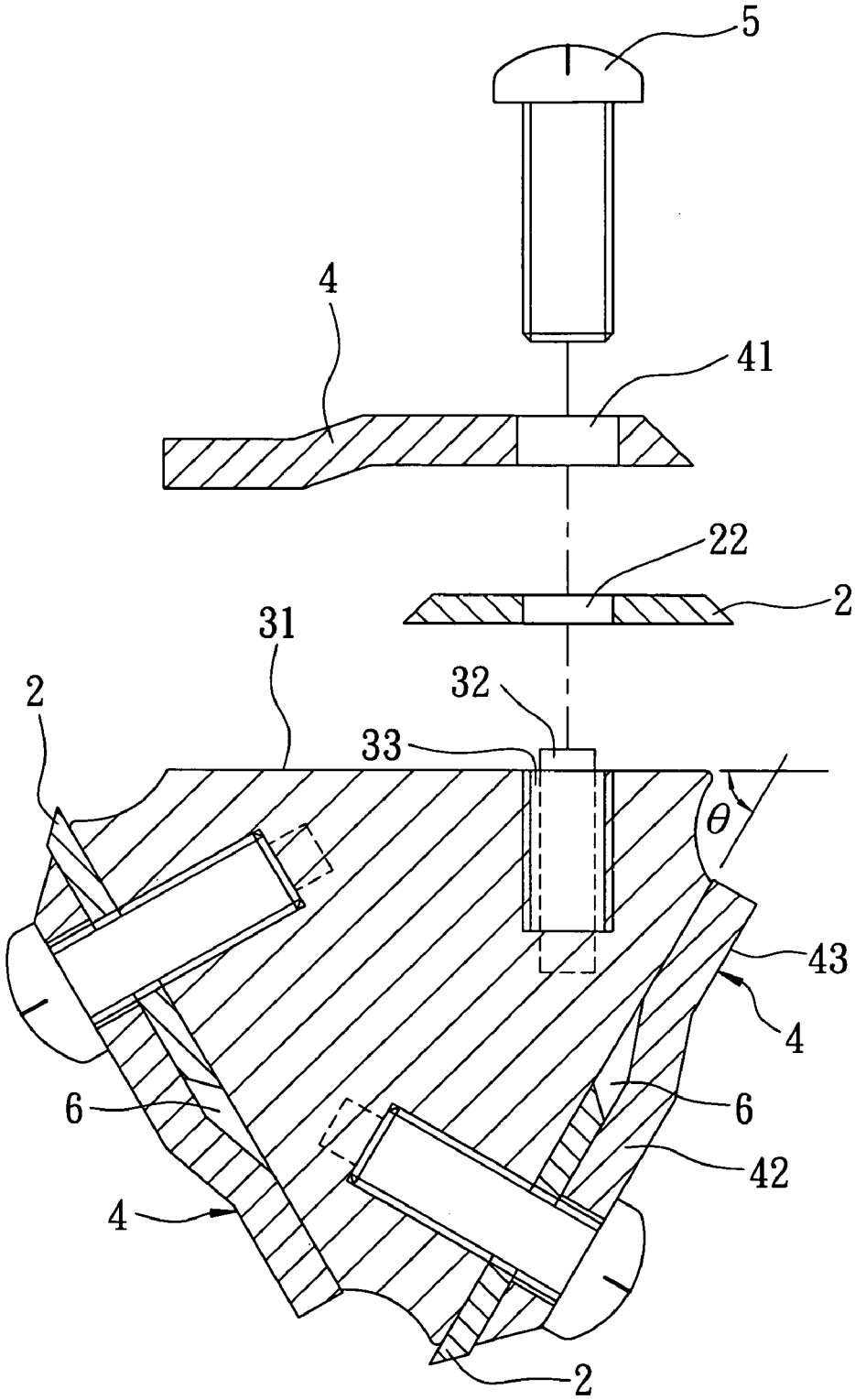
FIG. 5 is a partly exploded, sectional view of the preferred embodiment of this invention, illustrating how a blade is assembled to a shaft of the preferred embodiment.

FIGS. 4 and 5 illustrate the preferred embodiment of a rotary cutter for a wood planing machine according to this invention.

The rotary cutter includes: an elongated polygonal shaft 3 that defines a rotation axis, that has axially extending blade-mounting surfaces 31 parallel to and surrounding the rotation axis, and that is formed with threaded holes 33 indented inwardly from each of the blade-mounting surfaces 31 and aligned in an axial direction relative to the rotation axis, and blade-aligning studs 32 projecting outwardly from each of the blade-mounting surfaces 31 for aligning a blade 2 during mounting of the blade 2 on a respective one of the blade-mounting surfaces 31 of the shaft 3, the blade-mounting surfaces 31 being equidistant from the rotation axis, two adjacent ones of the blade-mounting surfaces 31 defining an angle $\theta$ therebetween, the angles $\theta$ defined by the blade-mounting surfaces 31 being equal; a plurality of elongated blade-fastening plates 4, each of which is attached to a respective one of the blade-mounting surfaces 31 of the shaft 3, each of which is formed with a plurality of through-holes 41 that are registered with the threaded holes 33 at the respective one of the blade-mounting surfaces 31, and each of which has a blade-contacting portion 42 that cooperates with the respective one of the blade-mounting surfaces 31 to define a blade-receiving gap 6 therebetween for receiving the blade 2 therein; and a plurality of fastening screws 5, each of which extends through a respective one of the through-holes 41 in a respective one of the blade-fastening plates 4, a respective through-hole 22 in the blade 2, and the blade-receiving gap 6, and engages threadedly a respective one of the threaded holes 33 in the shaft 3 so as to fasten the blade 2 to the respective one of the blade-mounting surfaces 31 of the shaft 3 upon tightening of the fastening screws 5.

In this embodiment, each of the blade-fastening plates 4 further has a shaft-contacting portion 43 that extends from the blade-contacting portion 42 and that abuts against the respective one of the blade-mounting surfaces 31 of the shaft 3.

The blade 2 is formed with holes 23 respectively for extension of the blade-aligning studs 32 of the shaft 3 therethrough so as to facilitate alignment of the blade 2 on the respective one of the blade-mounting surfaces 31 of the shaft 3.

Figure 6:
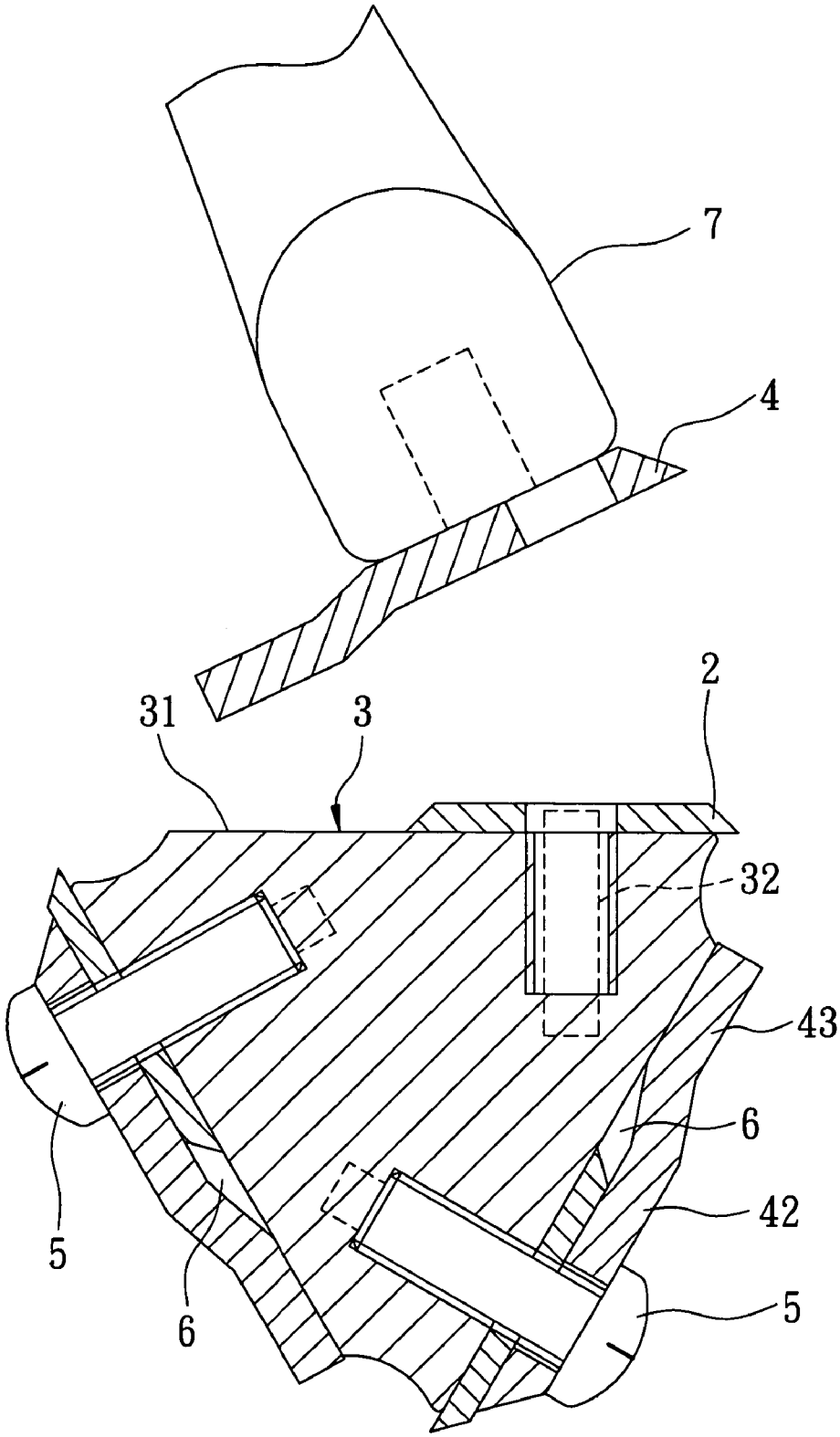
FIG. 6 is a partly exploded, sectional view of the preferred embodiment of this invention, illustrating how the blade is disassembled from the shaft of the preferred embodiment.

Referring to FIG. 6, the blade 2 can be easily replaced by loosening the fastening screws 5 thereon, and removed subsequently from the blade-mounting surface 31 of the shaft 3 using a magnet 7.

Since heads of the fastening screws 5 can be easily accessed, the blades 2 on the blade-mounting surfaces 31 of the shaft 3 can be easily replaced, thereby eliminating the drawback associated with the prior art.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A rotary cutter for a wood planing machine, comprising:

an elongated polygonal shaft that defines a rotation axis, that has axially extending blade-mounting surfaces parallel to and surrounding said rotation axis, and that is formed with threaded holes indented inwardly from each of said blade-mounting surfaces and aligned in an axial direction relative to said rotation axis, and blade-aligning studs projecting outwardly from each of said blade-mounting surfaces for aligning a blade during mounting of the blade on a respective one of said blade-mounting surfaces of said shaft, said blade-mounting surfaces being equidistant from said rotation axis, two adjacent ones of said blade-mounting surfaces defining an angle therebetween, said angles defined by said blade-mounting surfaces being equal;

a plurality of elongated blade-fastening plates, each of which is attached to a respective one of said blade-mounting surfaces of said shaft, each of which is formed with a plurality of through-holes that are respectively registered with said threaded holes at the respective one of said blade-mounting surfaces, and each of which cooperates with the respective one of said blade-mounting surfaces to define a blade-receiving gap therebetween for receiving the blade therein; and a plurality of fastening screws, each of which extends through a respective one of said through-holes in a respective one of said blade-fastening plates and said blade-receiving gap and engages threadedly a respective one of said threaded holes in said shaft so as to fasten the blade to the respective one of said blade-mounting surfaces of said shaft upon tightening of said fastening screws.

* * * * *